US008397912B1

(12) United States Patent
Chen

(10) Patent No.: US 8,397,912 B1
(45) Date of Patent: Mar. 19, 2013

(54) ROTARY TOOLBOX

(71) Applicant: Good Year Hardware Co., Ltd., Changhua (TW)

(72) Inventor: Tsai-Ching Chen, Changhua (TW)

(73) Assignee: Good Year Hardware Co., Ltd., Fu Sing Hsing, Changhua (TW)

( * ) Notice: Subject to any disclaimer, the term of this patent is extended or adjusted under 35 U.S.C. 154(b) by 0 days.

(21) Appl. No.: 13/650,978

(22) Filed: Oct. 12, 2012

(51) Int. Cl.
*B65D 85/20* (2006.01)

(52) U.S. Cl. ..... 206/379

(58) Field of Classification Search ..... 206/372, 206/373, 374, 375, 376, 377, 378, 379
See application file for complete search history.

(56) References Cited

U.S. PATENT DOCUMENTS

| | | | | |
|---|---|---|---|---|
| 7,661,526 | B2 * | 2/2010 | Lin | 206/379 |
| 8,186,510 | B1 * | 5/2012 | Chen | 206/375 |
| 2006/0016706 | A1 * | 1/2006 | Chen | 206/379 |
| 2009/0255840 | A1 * | 10/2009 | Lin | 206/379 |

* cited by examiner

*Primary Examiner* — Jacob K Ackun
(74) *Attorney, Agent, or Firm* — Muncy, Geissler, Olds & Lowe, PLLC

(57) ABSTRACT

A rotary toolbox includes a box body defining a first opening and a second opening, a hollow shaft mounted in the box body in communication with the first opening and having a third opening on the periphery, a locking member having a first protruding rod inserted through the third opening, a compression spring stopped against the locking member, a tool tray having a through hole pivotally coupled to the hollow shaft and a first locating groove disposed in the through hole and providing a carrier portion, a spiral spring connected between the box body and the tool tray. After pressing the locking member to move the first protruding rod out of the locating groove, the spiral spring will bias the tool tray to carry the carrier portion to the second opening for allowing the user to store tool parts or to pick up storage tool parts.

12 Claims, 15 Drawing Sheets

ROTARY TOOLBOX

BACKGROUND OF THE INVENTION

1. Field of the Invention

The present invention relates to toolboxes for storing tool parts and accessories and more particularly, to a rotary toolbox.

2. Description of the Related Art

Conventional toolboxes are normally configured to have a sliding inner case accommodated in an outer case, or, to have a lid that opens on a hinge. These conventional toolbox designs commonly have the inner box be divided into multiple vertically and/or horizontally spaced compartments for storing classified tools and related parts. If the user needs to change the tool or the attached part of the tool during working, the user must pull the inner box out of the outer box or open the lid again to access to the storage tools and related parts. The actual use of these conventional toolboxes is not convenient.

SUMMARY OF THE INVENTION

The present invention has been accomplished under the circumstances in view. It is the main object of the present invention to provide a rotary toolbox, which facilitates easy access to storage tools and parts.

To achieve this and other objects of the present invention, a rotary toolbox comprises a box body defining a first opening and a second opening; a hollow shaft mounted in the box body in communication with the first opening, the hollow shaft comprising a third opening located on the periphery thereof; a locking member accommodated in the hollow shaft, the locking member comprising a first protruding rod inserted through the third opening and movable along the hollow shaft; a compression spring having two opposite ends thereof respectively stopped against the locking member and the box body to impart a pressure to the locking member relative to the box body toward the first opening; a tool tray comprising a through hole pivotally coupled to the hollow shaft, a first locating groove disposed in the through hole for accommodating the first protruding rod, a stop portion and a carrier portion, the stop portion being movable with the tool tray to interfere with one of the locking member and the box body, the carrier portion being rotatable with the tool tray into alignment with the second opening for allowing the user to pick up or store tool parts; and a spiral spring mounted around the hollow shaft and connected between the box body and the tool tray for biasing the tool tray about the hollow shaft relative to the box body.

By means of pressing the locking member to disengage the first protruding rod from the first locating groove, the spiral spring immediately drives the tool tray to carry the carrier portion to the second opening, allowing the user to store tool parts or to pick up storage tool parts.

To achieve this and other objects of the present invention, a rotary toolbox comprises a box body defining a first opening and a second opening; a locking member comprising a third locating groove and a fourth locating groove located on the periphery thereof and a third protruding rod disposed at a top side thereof, the fourth locating groove being coupled to the guide rod and movable with the locking member along the hollow shaft; a compression spring having two opposite ends thereof respectively stopped against the locking member and the box body to impart a pressure to the locking member relative to the box body toward the first opening; a tool tray comprising a through hole pivotally coupled to the hollow shaft, a fourth protruding rod disposed in the through hole and receivable in the third locating groove, and a carrier portion, the carrier portion being rotatable with the tool tray into alignment with the second opening for allowing the user to pick up or store tool parts; and a spiral spring mounted around the hollow shaft and connected between the box body and the tool tray for biasing the tool tray about the hollow shaft relative to the box body.

By means of pressing the locking member to overcome the elastic potential energy of the compression spring and to further disengage the fourth protruding rod from the third locating groove, the spiral spring immediately drives the tool tray to carry the carry to the second opening, allowing the user to store tool parts or to pick up storage tool parts.

Other advantages and features of the present invention will be fully understood by reference to the following specification in conjunction with the accompanying drawings, in which like reference signs denote like components of structure.

DETAILED DESCRIPTION OF THE INVENTION

Figure 1:
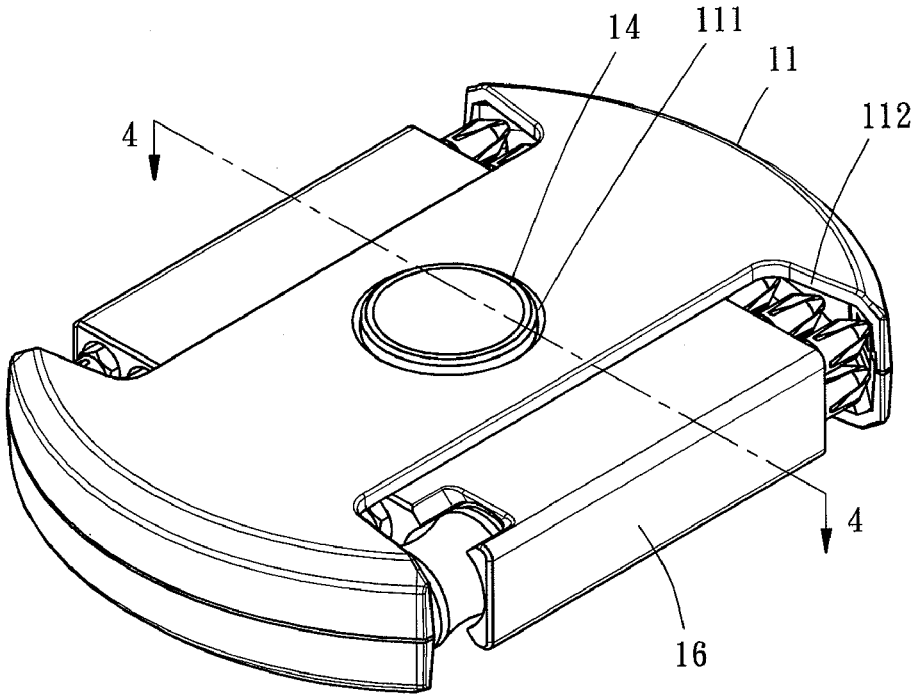
FIG. 1 is an elevational view of a rotary toolbox in accordance with a first embodiment of the present invention.
Figure 2:
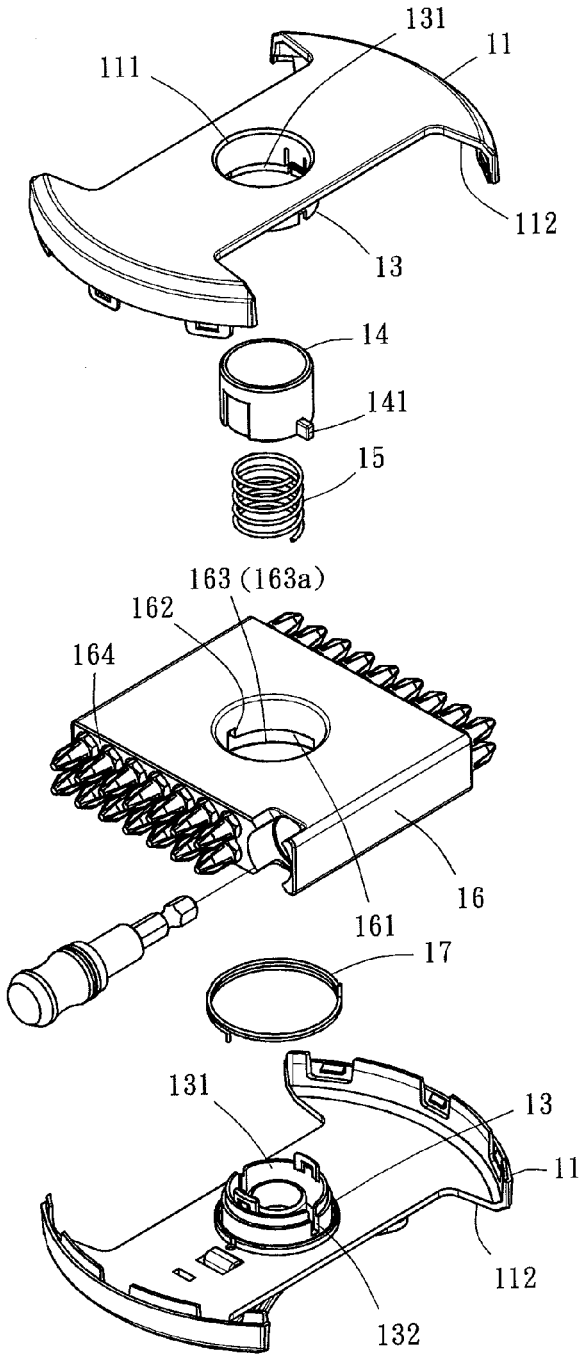
FIG. 2 is an exploded view of the rotary toolbox in accordance with the first embodiment of the present invention.
Figure 3:
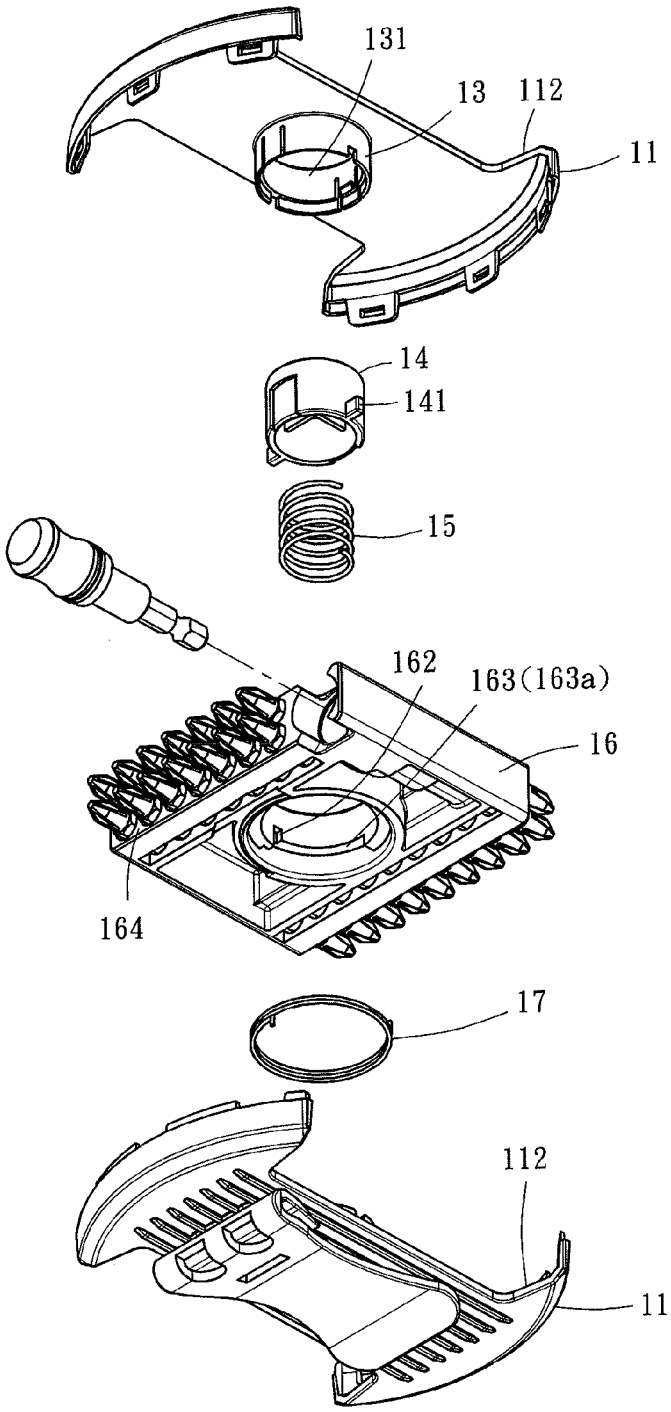
FIG. 3 corresponds to FIG. 2 when viewed from another angle.
Figure 4:
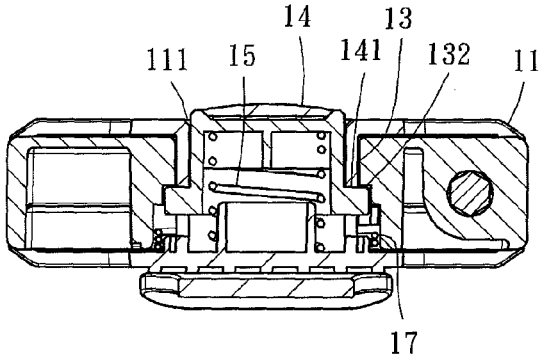
FIG. 4 is a sectional view taken along line 4-4 of FIG. 1.
Figure 5:
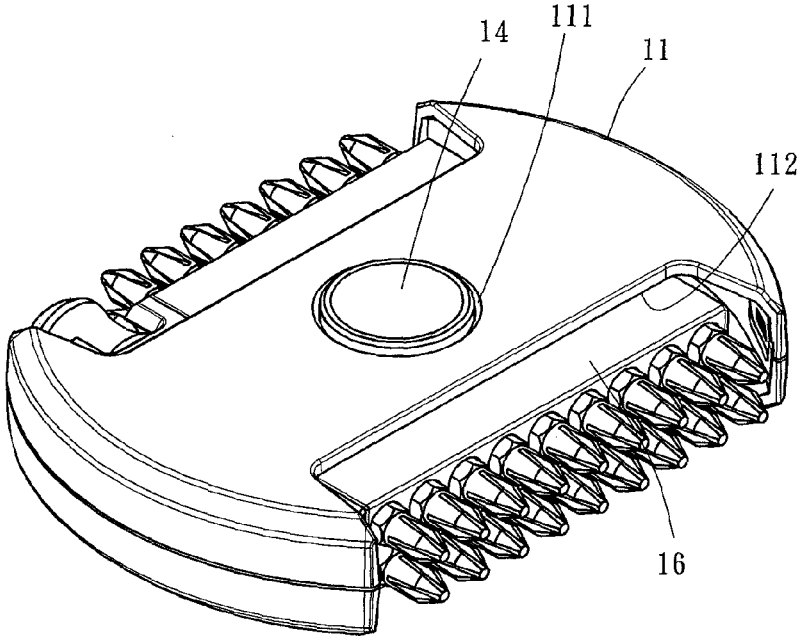
FIG. 5 is a schematic drawing illustrating an application example of the rotary toolbox in accordance with the first embodiment of the present invention.
Figure 6:
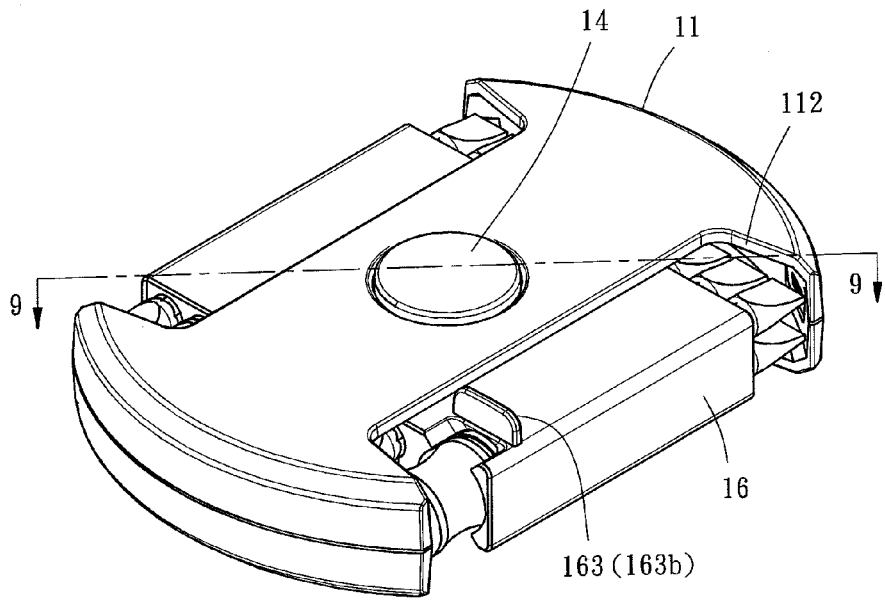
FIG. 6 is an elevational view of a rotary toolbox in accordance with a second embodiment of the present invention.
Figure 7:
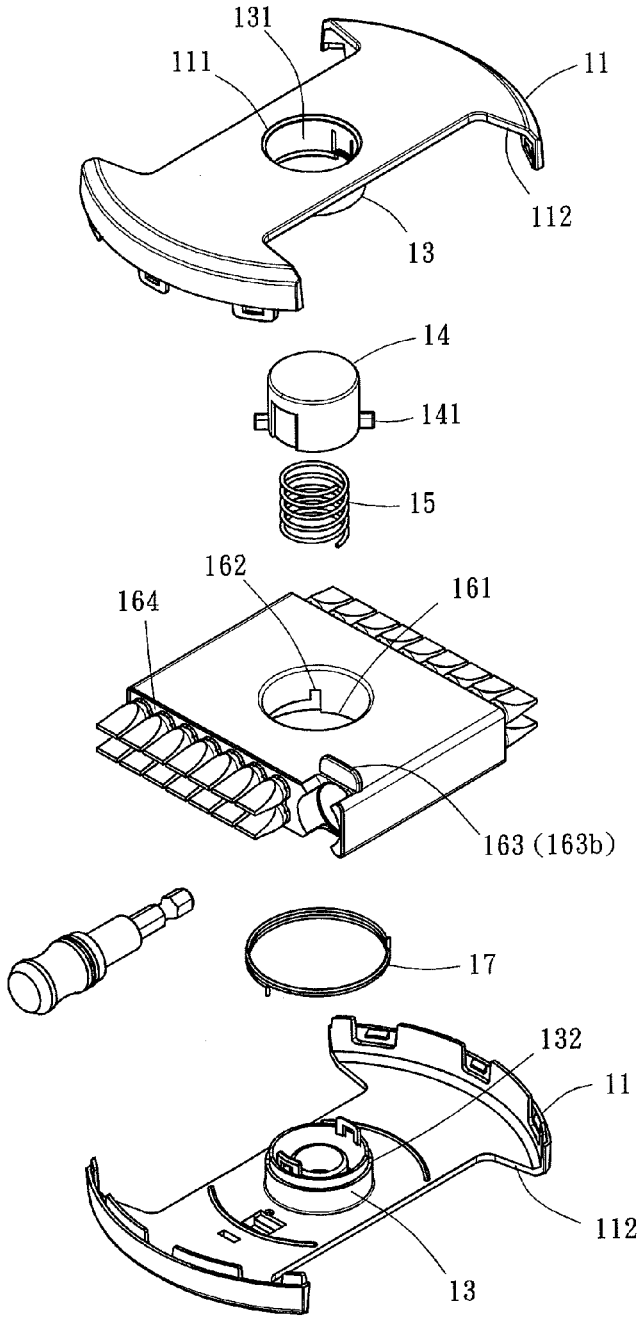
FIG. 7 is an exploded view of the rotary toolbox in accordance with the second embodiment of the present invention.
Figure 8:
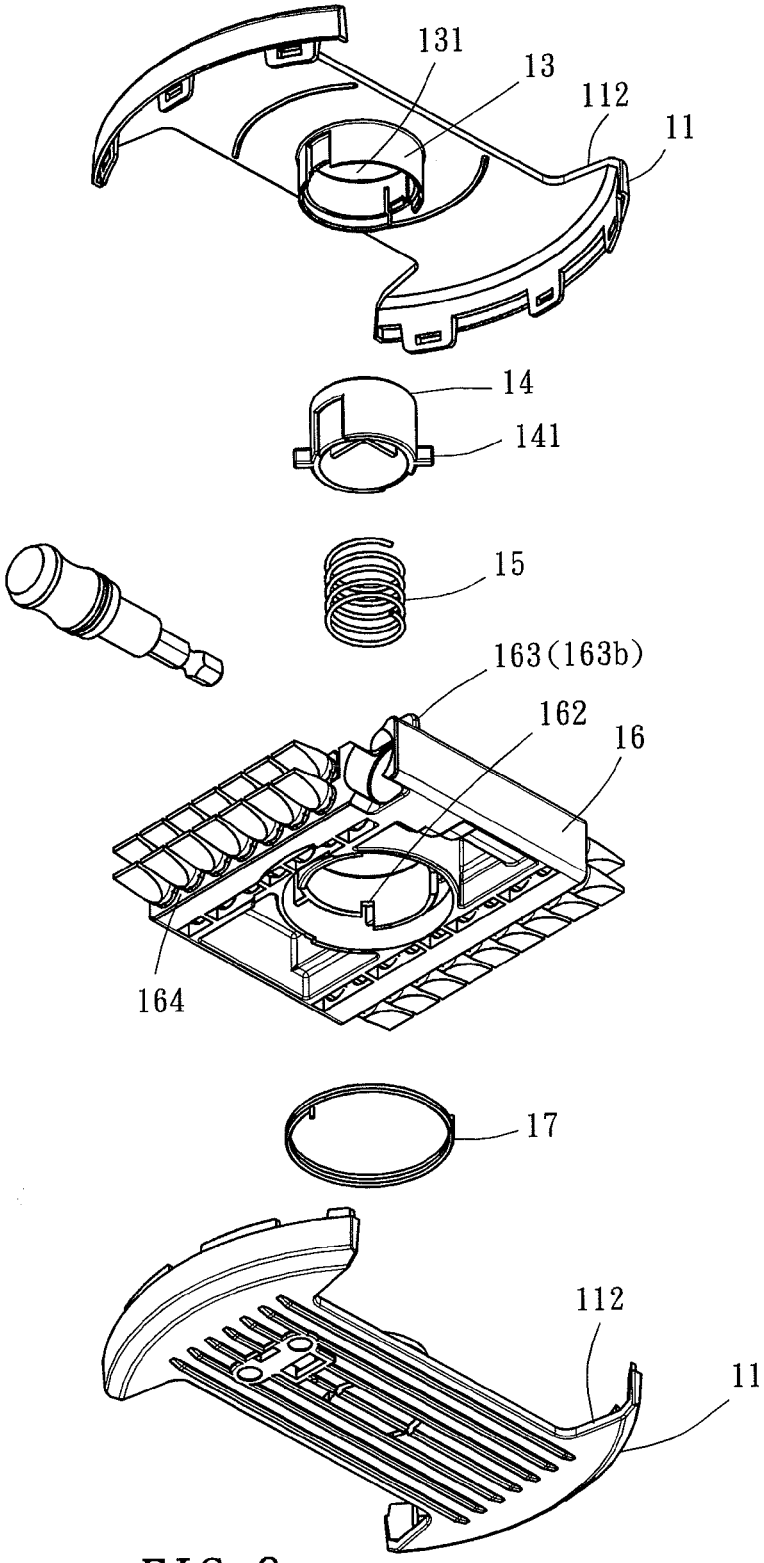
FIG. 8 corresponds to FIG. 7 when viewed from another angle.
Figure 9:
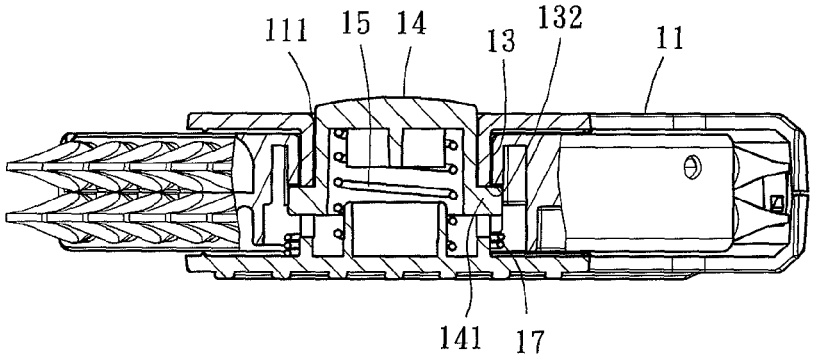
FIG. 9 is a sectional view taken along line 6-6 of FIG. 9.
Figure 10:
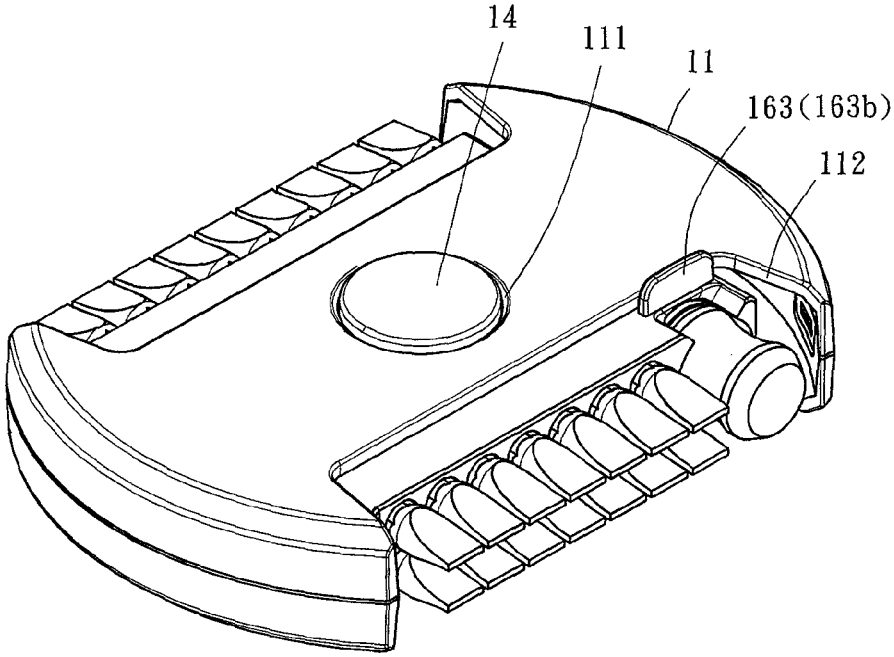
FIG. 10 is a schematic drawing illustrating an application example of the rotary toolbox in accordance with the second embodiment of the present invention.

Referring to FIGS. 1-5, a rotary toolbox in accordance with a first embodiment of the present invention is shown comprising a box body 11, a hollow shaft 13, a locking member 14, a compression spring 15, a tool tray 16, and a spiral spring 17.

The box body 11 defines a first opening 111 and a second opening 112.

The hollow shaft 13 is mounted in the box body 11 in communication with the first opening 111 and defining a third opening 132 on the peripheral wall. It is to be noted that the hollow shaft 13 can be made integrally with the box body 11 in one piece. Alternatively, the hollow shaft 13 can be separately made and then affixed to the box body 11. In this embodiment, the hollow shaft 13 is separately made and then affixed to the box body 11.

The locking member 14 is accommodated in the hollow shaft 13, comprising a first protruding rod 141 extended from the periphery thereof and inserted through and movable along the third opening 132 for guiding movement of the locking member 14 axially along the hollow shaft 13.

The compression spring 15 has its two opposite ends respectively stopped against the locking member 14 and the box body 11 to impart a pressure to the locking member 14 toward the first opening 111.

The tool tray 16 comprises a through hole 161 pivotally coupled to the hollow shaft 13, a first locating groove 162 for receiving the first protruding rod 141, a stop portion 163 and a carrier portion 164. The stop portion 163 can be forced to interfere with the locking member 14 or the box body 11 after a rotary motion of the tool tray 16. The carrier portion 164 is rotatable with the tool tray 16 into alignment with the second opening 112 for allowing the user to pick up or store tool parts.

It is to be noted that in this first embodiment of the present invention, the stop portion 163 is a second locating groove 163*a* formed in the hole wall of the through hole 161 in communication with the first locating groove 162; the first locating groove 162 has a length shorter than the length of the second locating groove 163*a*. The first locating groove 162 is disposed relatively closer to the first opening 111 than the length of the second locating groove 163*a*; the second locating groove 163*a* can accommodate the first protruding rod 141 and allows the first protruding rod 141 to be alternatively moved between the first locating groove 162 and the second locating groove 163*a*.

The spiral spring 171 is mounted around the hollow shaft 13 with its two opposite ends respectively and fixedly connected to the box body 11 and the tool tray 16 for driving the tool tray 16 to turn about the hollow shaft 13.

The operation of the rotary toolbox in accordance with this first embodiment of the present invention is explained hereinafter.

The operation of the rotary toolbox includes a procedure for opening the rotary toolbox and a procedure for closing the rotary toolbox.

1. Procedure to Open the Toolbox:

Press the locking member 14 to overcome the elastic potential energy of the compression spring 15 and then drive the locking member 14 to move the first protruding rod 141 away from the first opening 111 and the first locating groove 162 into the second locating groove 163*a*, enabling the tool tray 16 to be biased by the spiral spring 17 to carry the carrier portion 164 to the second opening 112 where the tool tray 16 is stopped by the first protruding rod 141 in the second locating groove 163*a* and the user can store tool parts in the rotary toolbox or pick up storage tool parts from the rotary toolbox.

2. Procedure to Close the Toolbox:

When going to receive the carrier portion 164 of the tool tray 16 inside the box body 11, apply a force to the tool tray 16 to overcome the elastic potential energy of the spiral spring 17 and then rotate the tool tray 16 to the extent where the first protruding rod 141 is pushed back into the first locating groove 162 by the compression spring 15. At this time, the tool tray 16 is received inside the box body 11 and stopped in place by the first protruding rod 141.

Thus, by means of pressing the locking member 14 or moving the tool tray 16, the toolbox can easily be shifted between an opening position and a closing position, allowing the user to store tool parts or pick up storage tool parts conveniently.

FIGS. 6-10 illustrate a rotary toolbox in accordance with a second embodiment. This second embodiment is substantially similar to the aforesaid first embodiment with the exception that the stop portion 153 of the tool tray 16 in accordance with this second embodiment is a second protruding rod 163*b* disposed in the second opening 112 and adapted to interfere with the box body 11 and to further stop the tool tray 16 from rotation.

The operation of the rotary toolbox in accordance with this second embodiment is explained hereinafter.

1. Procedure to Open the Toolbox:

Press the locking member 14 to overcome the elastic potential energy of the compression spring 15 and then drive the locking member 14 to move the first protruding rod 141 away from the first opening 111 and the first locating groove 162 into the second locating groove 163*a*, enabling the tool tray 16 to be biased by the spiral spring 17 to carry the carrier portion 164 to the second opening 112 where the second protruding rod 163 is stopped by the box body 11 and the user can store tool parts in the rotary toolbox or pick up storage tool parts from the rotary toolbox.

2. Procedure to Close the Toolbox:

When going to receive the carrier portion 164 of the tool tray 16 inside the box body 11, apply a force to the tool tray 16 to overcome the elastic potential energy of the spiral spring 17 and then rotate the tool tray 16 to the extent where the first protruding rod 141 is pushed back into the first locating groove 162 by the compression spring 15. At this time, the tool tray 16 is received inside the box body 11 and stopped in place by the first protruding rod 141.

Thus, by means of pressing the locking member 14 or moving the tool tray 16, the toolbox can easily be shifted between an opening position and a closing position, allowing the user to store tool parts or pick up storage tool parts conveniently.

Figure 11:
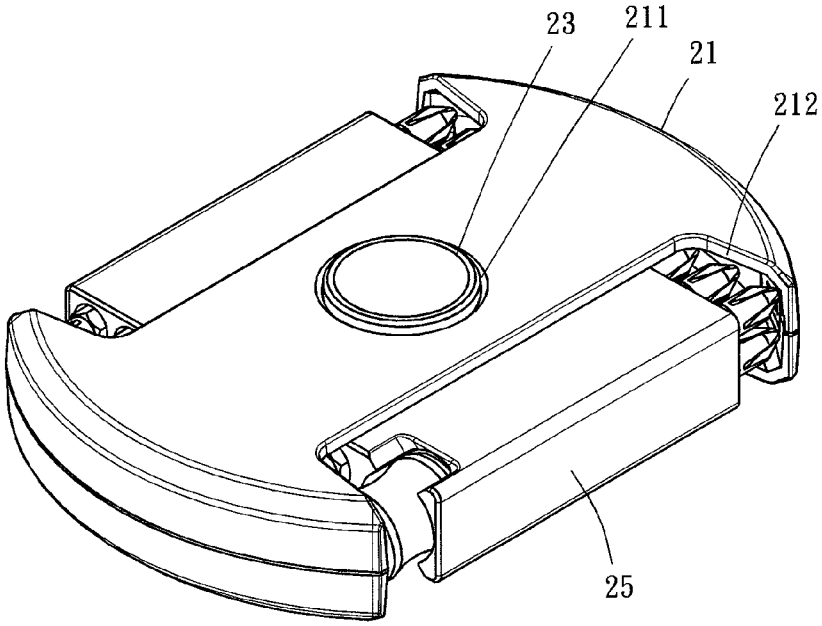
FIG. 11 is an elevational view of a rotary toolbox in accordance with a third embodiment of the present invention.
Figure 12:
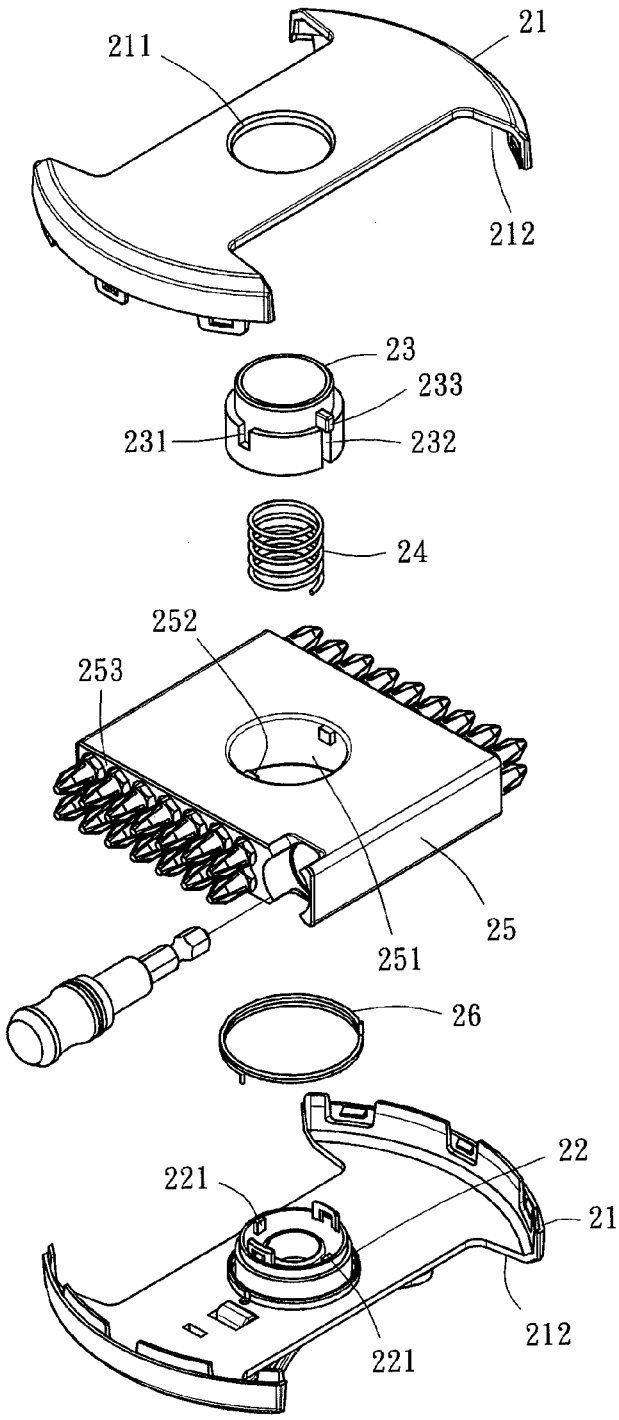
FIG. 12 is an exploded view of the rotary toolbox in accordance with the third embodiment of the present invention.
Figure 13:
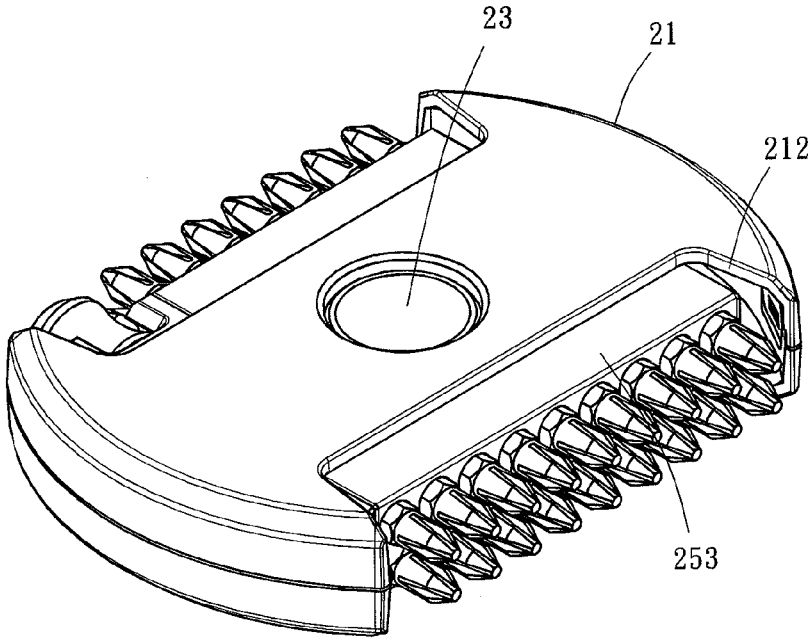
FIG. 13 is a schematic drawing illustrating an application example of the rotary toolbox in accordance with the third embodiment of the present invention.

FIGS. 11-13 illustrate a rotary toolbox in accordance with a third embodiment of the present invention. According to this third embodiment, the rotary toolbox comprises a box body 21, a hollow shaft 22, a locking member 23, a compression spring 24, a tool tray 25 and a spiral spring 26.

The box body 21 defines a first opening 211 and a second opening 212.

The hollow shaft 22 is inserted into the inside of the box body 21, comprising a guide rod 221.

The locking member 23 comprises a third locating groove 231 and a fourth locating groove 232 located on the periphery, and a third protruding rod 233 disposed at a top side thereof. By means of coupling the fourth locating groove 232 to the guide rod 221, the locking member 23 is received in and axially movable along the hollow shaft 22.

The compression spring 24 has its two opposite ends respectively stopped against the locking member 23 and the box body 21 to impart a pressure to the locking member 23 toward the first opening 211.

The tool tray 25 comprises a through hole 251 pivotally coupled to the hollow shaft 22, a fourth protruding rod 252 protruding in the through hole 251, and a carrier portion 253. The fourth protruding rod 252 can be received in the third locating groove 231. The carrier portion 253 is rotatable with the tool tray 25 into alignment with the second opening 212 for allowing the user to store tool parts or to pick up storage tool parts.

The spiral spring 26 is mounted around the hollow shaft 22 with its two opposite ends respectively and fixedly connected to the box body 31 and the tool tray 25 for driving the tool tray 25 to turn about the hollow shaft 22 relative to the box body 21.

The user can press the locking member 23 to overcome the elastic potential energy of the compression spring 24 and to further release the fourth protruding rod 252 from the third locating groove 231 for enabling the spiral spring 26 to bias the tool tray 25 to the position where the carrier portion 253 is kept in alignment with the second opening 212 for allowing the user to tore tool parts or to pick up storage tool parts.

Figure 14:
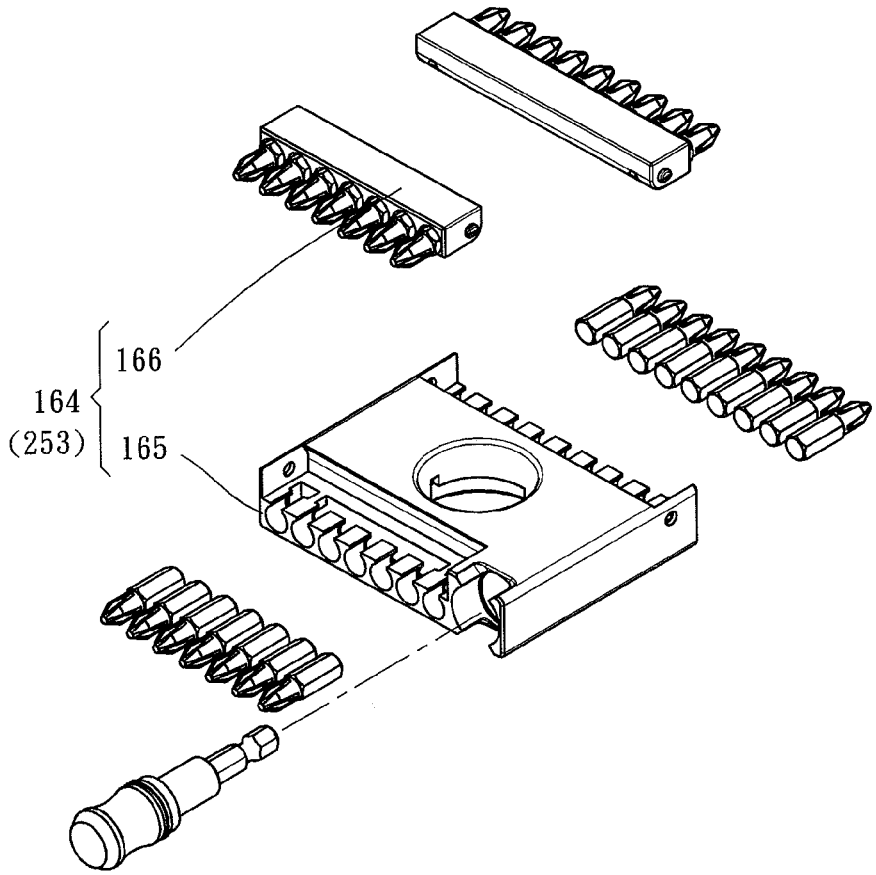
FIG. 14 is an exploded view of the rotary toolbox in accordance with a fourth embodiment of the present invention.
Figure 15:
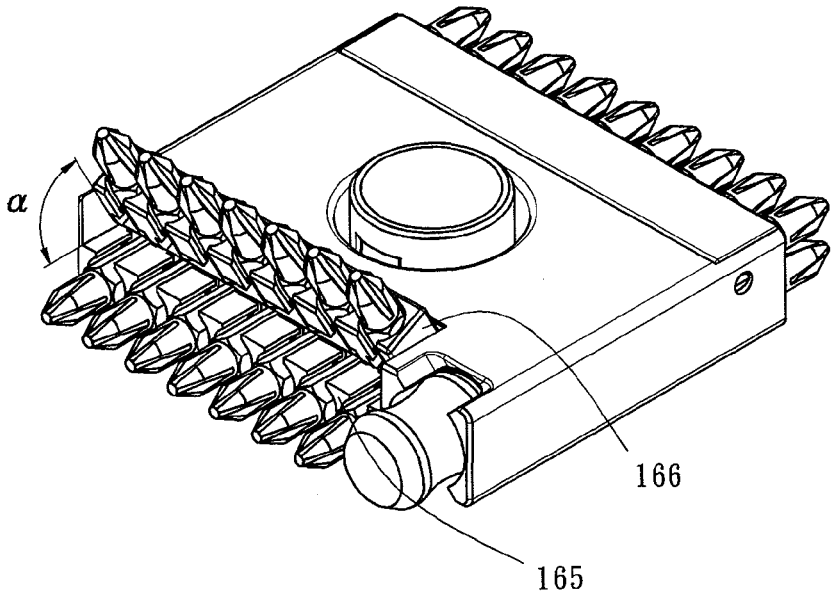
FIG. 15 is a schematic drawing illustrating an application example of the rotary toolbox in accordance with the fourth embodiment of the present invention.
Figure 16:
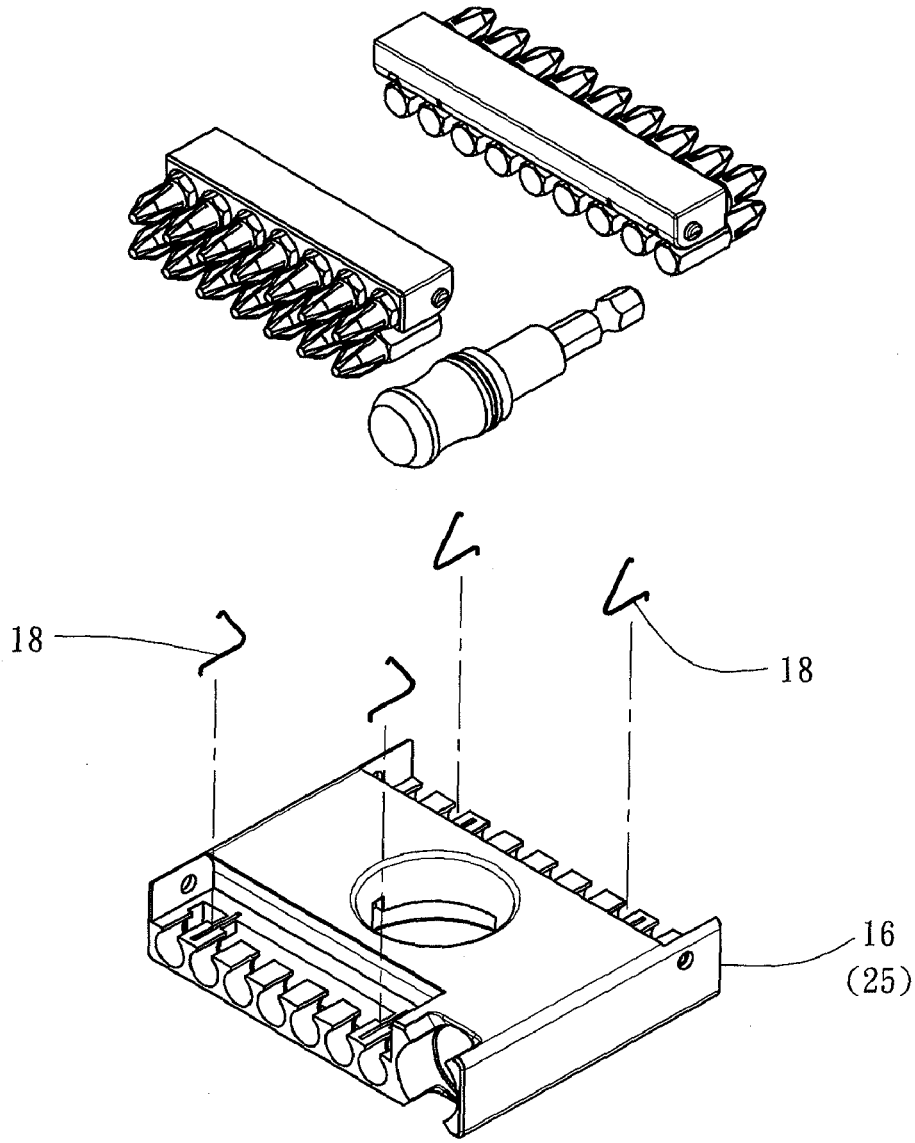
FIG. 16 is an exploded view of a part of the fourth embodiment of the present invention, illustrating the relationship between the torsion springs and the tool tray.

FIGS. 14-16 illustrate a rotary toolbox in accordance with a fourth embodiment, this fourth embodiment is substantially similar to the aforesaid second and third embodiments with the exception that the carrier portion 164 (253) in accordance with this fourth embodiment further comprises a fixed part 165 for keeping tool parts, and a movable part 166 pivotally connected to the fixed part 165 and can be lifted from the fixed part 165 to a lifted position where the fixed part 165 and the movable part 166 define a contained angle $\alpha°$. Thus, after moved the tool tray 16 (25) to the position in alignment with the second opening 112 (212), the user can lift the movable part 166 to the lifted position for storing tool parts or picking up storage tool parts conveniently.

This fourth embodiment further comprises a torsion spring 18 having two opposite ends thereof respectively and fixedly connected to the fixed part 165 and the movable part 166 to impart a pressure to the movable part 166 in direction away from the fixed part 165 toward the lifted position. Preferably, the contained angle $\alpha°$ is smaller than 90°. Thus, when the tool tray 16 (25) reaches the position in alignment with the second opening 112 (212), the movable part 166 is automatically lifted to the lifted position by the torsion spring 18. In this case, when going to close the toolbox, the user must overcome the elastic potential energy of the torsion spring 18 to have the movable part 166 and the fixed part 165 be received together and then rotate the tool tray 16 (25) to the closed position.

Further, it is to be understood that, in this fourth embodiment, the user can directly rotate the tool tray 16 (25) relative to the box body 11. When rotating the tool tray 16 (25) relative to the box body 11 (21), the movable part 166 will be forced by the box body 11 (21) toward the fixed part 165 and then received with the fixed part 165 into the inside of the box body 11 (21).

Figure 17:
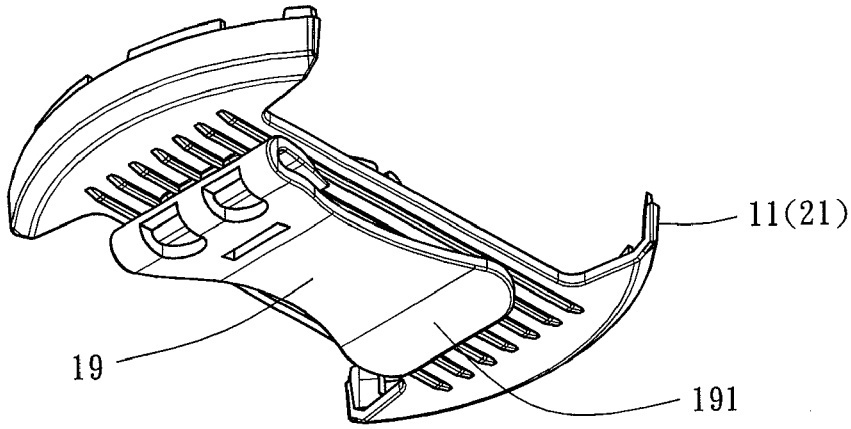
FIG. 17 is an exploded view of a rotary toolbox in accordance with a fifth embodiment of the present invention.

FIG. 17 illustrates a rotary toolbox in accordance with a fifth embodiment of the present invention. This fifth embodiment is substantially similar to the aforesaid fourth embodiment with the exception that this fifth embodiment further comprises a clip 19. The clip 19 has its one end, namely, the fixed end detachably fastened to the box body 11 (21), and its other end, namely, the free end terminating in a clamping portion 191 disposed in contact with the outer surface of the box body 11 (21). The arrangement of the clip 19 enables the user to secure the rotary toolbox to a part of the clothes, for example, the waist belt, facilitating carrying.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A rotary toolbox, comprising:

a box body defining a first opening and a second opening;

a hollow shaft mounted in said box body in communication with said first opening, said hollow shaft comprising a third opening located on the periphery thereof;

a locking member accommodated in said hollow shaft, said locking member comprising a first protruding rod inserted through said third opening and movable along said hollow shaft;

a compression spring having two opposite ends thereof respectively stopped against said locking member and said box body to impart a pressure to said locking member relative to said box body toward said first opening;

a tool tray comprising a through hole pivotally coupled to said hollow shaft, a first locating groove disposed in said through hole for accommodating said first protruding rod, a stop portion and a carrier portion, said stop portion being rotated with said tool tray to interfere with one of said locking member and said box body, said carrier portion being rotated with said tool tray into alignment with said second opening for allowing the user to pick up or store tool parts; and a spiral spring mounted around said hollow shaft and connected between said box body and said tool tray for biasing said tool tray about said hollow shaft relative to said box body.

2. The rotary toolbox as claimed in claim 1, wherein said stop portion is a second locating groove located on a hole wall of said through hole in communication with said first locating groove, said first locating groove having a length shorter than said second locating groove, said first locating groove being disposed relatively closer to said first opening than said second locating groove, said second locating groove being adapted for accommodating said first protruding rod for enabling said first protruding rod to be alternatively movable between said first locating groove and said second locating groove.

3. The rotary toolbox as claimed in claim 1, wherein said stop portion is a second protruding rod extended from said tool tray and adapted to interfere with said box body in said second opening to further top said tool tray from rotation.

4. The rotary toolbox as claimed in claim 1, wherein said carrier portion further comprising a fixed part and a movable part pivotally connected to said fixed part and liftable relative to said fixed part to a lifted position where said fixed part and said movable part define a predetermined contained angle.

5. The rotary toolbox as claimed in claim 4, further comprising a torsion spring connected between said fixed part and said movable part and adapted to impart a pressure said movable part relative to said fixed part toward said lifted position.

6. The rotary toolbox as claimed in claim 5, wherein said contained angle is smaller than 90° angle.

7. The rotary toolbox as claimed in claim 1, further comprising a clip, said clip comprising a fixed end detachably fastened to said box body and a free end terminating in a clamping portion disposed in contact with said box body.

8. A rotary toolbox, comprising:

a box body defining a first opening and a second opening;

a hollow shaft mounted in said box body, said hollow shaft comprising a guide rod disposed therein;

a locking member comprising a third locating groove and a fourth locating groove located on the periphery thereof and a third protruding rod disposed at a top side thereof, said fourth locating groove being coupled to said guide rod and movable with said locking member along said hollow shaft;

a compression spring having two opposite ends thereof respectively stopped against said locking member and said box body to impart a pressure to said locking member relative to said box body toward said first opening;

a tool tray comprising a through hole pivotally coupled to said hollow shaft, a fourth protruding rod disposed in said through hole and receivable in said third locating groove, and a carrier portion, said carrier portion being rotatable with said tool tray into alignment with said second opening for allowing the user to pick up or store tool parts; and a spiral spring mounted around said hollow shaft and connected between said box body and said tool tray for biasing said tool tray about said hollow shaft relative to said box body.

9. The rotary toolbox as claimed in claim 8, wherein said carrier portion further comprising a fixed part and a movable part pivotally connected to said fixed part and liftable relative to said fixed part to a lifted position where said fixed part and said movable part define a predetermined contained angle.

10. The rotary toolbox as claimed in claim 9, further comprising a torsion spring connected between said fixed part and said movable part and adapted to impart a pressure said movable part relative to said fixed part toward said lifted position.

11. The rotary toolbox as claimed in claim 10, wherein said contained angle is smaller than 90° angle.

12. The rotary toolbox as claimed in claim 8, further comprising a clip, said clip comprising a fixed end detachably fastened to said box body and a free end terminating in a clamping portion disposed in contact with said box body.

* * * * *